United States Patent [19]

Hodgson

[11] 4,242,066

[45] Dec. 30, 1980

[54] ROTARY PUMPS AND MOTORS AND THRUST PLATES THEREFOR

[75] Inventor: Robert F. Hodgson, Youngstown, Ohio

[73] Assignee: Commercial Shearing, Inc., Youngstown, Ohio

[21] Appl. No.: 936,205

[22] Filed: Aug. 24, 1978

[51] Int. Cl.[3] ..... F04C 2/18

[52] U.S. Cl. ..... 418/132

[58] Field of Search ..... 418/133, 135, 131, 132

[56] References Cited

U.S. PATENT DOCUMENTS

| | | | |
|---|---|---|---|
| 2,809,592 | 10/1957 | Miller et al. | 418/132 |
| 3,348,492 | 10/1967 | Olson et al. | 418/131 |
| 3,748,063 | 7/1973 | Putnam | 418/132 |
| 3,904,333 | 9/1975 | Stoeckelmann | 418/132 |
| 3,961,872 | 6/1976 | Muller et al. | 418/132 |

FOREIGN PATENT DOCUMENTS

| | | | |
|---|---|---|---|
| 2419855 | 11/1974 | Fed. Rep. of Germany | 418/132 |

*Primary Examiner*—Leonard E. Smith

*Attorney, Agent, or Firm*—Buell, Blenko, Ziesenheim & Beck

[57] ABSTRACT

A gear pump or motor and a thrust plate therefor are provided having a case, a pair of rotary gears in said case, said gears having axial stub shafts journaled in said case, a unitary thrust plate for the corresponding ends of the pair of rotary gears adapted to lie between the case and the ends of the gears, said thrust plate being of a metal softer than the gears and having a front face adapted to abut the gear ends and a rear face abutting the case, a pair of spaced openings extending through said plate to receive the gear stub shafts, a pair of annular grooves in the rear face spaced from and surrounding each of said openings, a groove in the rear face connecting said annular grooves at their closest points, at least one groove in the rear face extending radially from each annular groove to the periphery of the body generally opposite the groove connecting the annular grooves defining at least two substantially identical areas on opposite sides of the body, a generally U-shaped elastomer gasket having the contour of the combined grooves on the rear face of the body and fitting into said grooves with the opening of the U-shaped gasket opening downwardly in the groove and resilient means acting on said gasket normally to urge it partially out of said grooves into sealing contact with the case.

22 Claims, 6 Drawing Figures

Fig. 1.
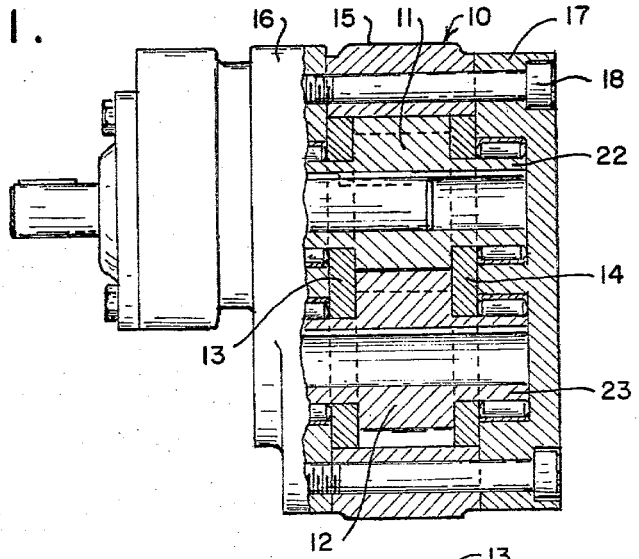
Fig. 2.
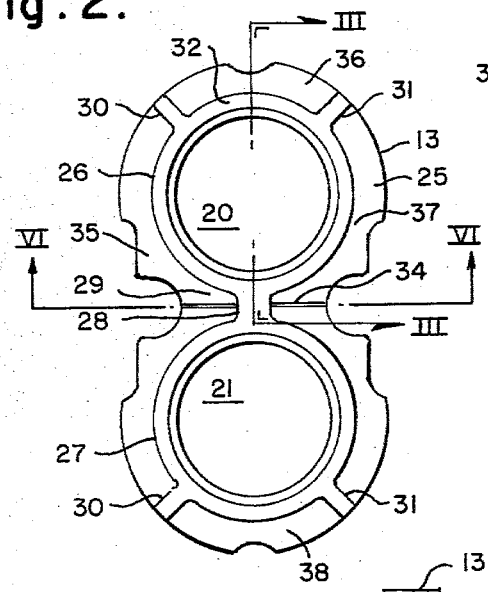
Fig. 3.
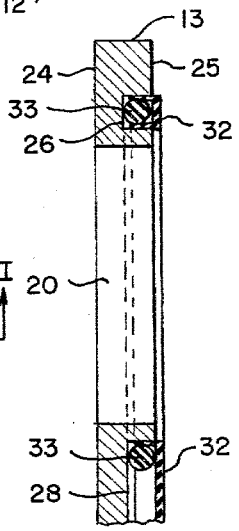
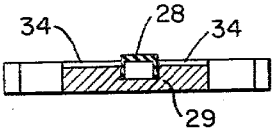
Fig. 6.
Fig. 4.
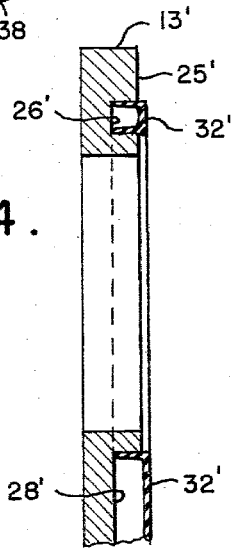
Fig. 5.
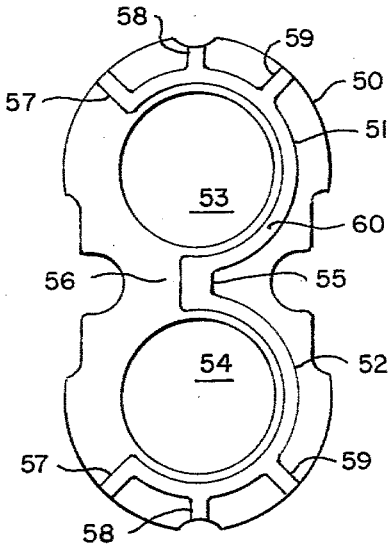

ROTARY PUMPS AND MOTORS AND THRUST PLATES THEREFOR

This invention relates to rotary pumps and motors and thrust plates threrefor and particularly to a thrust plate which provides a combined mechanical and hydraulic seal between the inlet and outlet sides of a gear pump or motor.

Gear pumps and motors have been used for many years to transmit power hydraulically from one point to another. As the pressure requirements for pumps and motors has increased over the years so also have the problems associated with wear and leakage, particularly around the gear ends. One of the major problems associated with such thrust plates has been the provision of sufficient sealing pressure between the thrust plate and the gear ends without providing excessive pressure which would result in excessive thrust plate wear. One method of providing a controlled pressure, balanced against the pressure within the pump or motor is to pressurize the thrust plate with the pressures of the pump or motor so that the pressure behind the plate is substantially the same as the pressure at its face. Such a system is disclosed in Kane U.S. Pat. No. 2,714,856. Unfortunately, however, there are many problems associated with forming and sealing the necessary pressure pockets on the reverse side of the thrust plate.

I have discovered a thrust plate structure and sealing arrangement which will satisfactorily isolate and seal the necessary pressure pockets of a thrust plate to provide minimal wear and maximum sealing efficiency.

I provide in a rotary gear pump or motor having a case, a pair of rotary gears in said case, said gears having axial stub shafts in the case, the improvement comprising a unitary thrust plate for the corresponding ends of the pair of rotary gears adapted to lie between the case and the ends of the gears comprising a metal body of metal softer than the gears having a front face adapted to abut the gear ends and a rear face abutting the case, a pair of spaced openings extending through the body to receive the gear stub shafts, an annular groove in the rear face spaced from and surrounding each of the openings, a groove on the rear face in the space between the openings connecting the annular grooves, at least one groove on the rear face extending from each annular groove to the periphery of the body defining at least two substantially identical areas on opposite side of the body, a generally U-shaped elastomer gasket having the contour of the combined grooves on the rear face of the body fitting into said grooves with the opening of the U downwardly in the groove and resilient means acting on said gasket normally to urge it partially out of said grooves. Preferably the body is in a generally figure 8 shape having a groove connecting the two annular grooves at the waist of the eight and a pair of grooves extending from the annular grooves to the periphery of the figure 8 body at the top and bottom of the figure 8 and forming with the gasket four isolated pressure pockets. I preferably provide a passage through the neck of the figure 8 body communicating from the periphery to the groove connecting the annular grooves, said passage carrying high pressure fluid from the pump to the interior of the groove beneath the gasket to pressurize the gasket at the maximum pressure in the pump and thereby seal the area between the body and the case to form pressure pockets behind the body. The resilient means acting on the gasket may be an elastomer O-ring structure or it may be simply long side arms on the U-shaped gasket which hold the gasket normally above the surface of the body.

In the foregoing general statement I have set out certain objects, purposes and advantages of my invention. Other objects, purposes and advantages of this invention will be apparent from a consideration of the following description and the accompanying drawings in which:

FIG. 1 is a partial section through a gear pump showing the thrust plate in position;

FIG. 2 is a plan view of a thrust plate assembly according to this invention;

FIG. 3 is a section on the line III—III of FIG. 2; and

FIG. 4 is a section through a second embodiment of thrust plate assembly according to this invention;

FIG. 5 is a plan view of a second embodiment of thrust plate according to the invention;

FIG. 6 is a section on the line VI—VI of FIG. 2.

Referring to the drawings I have illustrated a rotary gear pump housing 10 having a pair of meshing gear impellers 11 and 12 between a pair of end thrust plates 13 and 14 with a central casing member 15 enclosing the outer periphery of the impellers and plates. The thrust plates 13 and 14 and casing member 15 are enclosed between a pair of end bells 16 and 17 held together by bolts 18 extending through the end bells and central casing member to hold them in tightly sealed relation around the impellers. The end thrust plates 13 and 14 are identical and will be described as thrust plate 13. The plate 13 is generally in the form of a figure 8 having a pair of openings 20 and 21 through which the stub shafts 22 and 23 of the impellers 11 and 12 extend. The front face of plate 13 is provided with a flat surface 24 fitting closely against the adjacent impeller ends. The rear face of plate 13 is a flat surface 25 having annular grooves 26 and 27 surrounding each of openings 24 and 25 and spaced radially uniformly away from each such opening. The grooves 26 and 27 are connected by a groove 28 across the neck 29 of the plate 13 and extending radially from each groove 26 and 27. Two radial spaced grooves 30 and 31 extend outwardly from each of said grooves 26 and 27 to the periphery of plate 13, generally opposite groove 28. A generally U-shaped rubber seal 32 having the configuration of all of the grooves 26 through 31 is fitted in the grooves with the open side down. Rubber O-rings 33 are placed under the seal 32 within the U to hold the seal 32 normally slightly above the surface 25 of the rear face of plate 13. Preferably shallow grooves or passages 34 extend traversely across neck 29 on both sides of groove 28 and communicate from the outer periphery of neck 29 to groove 28. In operation the O-rings 33 pressurize the seal 32 against the inner face of end bell 16 forming four pressure pockets 35, 36, 37 and 38 between the rear face of thrust plate 13 and the adjoining face of the end bell 16. When the gears are rotated to build up pressure on one side of the pump, fluid will go along one of the passages 34 to groove 28 intermediate the top and bottom of the V-shaped gasket, down between the U-shaped gasket and groove and through beneath seal 32, pressurizing the seal to the maximum pressure of the pump. The edge of the U-shaped seal acts as a check valve. At the same time fluid will enter pockets 35, 36, 37 and 38 from the adjoining gears, pressurizing each pocket to the same pressure as the area with which the pocket communicates. This will then pressurize the thrust plate 13 against the ends of the gears uniformly over its whole area, since the pressures acting on the front face and the rear face at each particular area will be equal. As a result, the thrust plate will not wear unequally and leakage from the high pressure side of the pump to the low pressure side is minimized, if not eliminated, making the pump more efficient and longer lived.

In the form illustrated in FIG. 4 the side walls of the U-shaped seal 32' are extended so that they are longer than the depth of grooves 26'–31' and thereby act to hold the seal above the rear surface 25' of thrust plate 13'. As a result the O-rings 33 are eliminated. Operationally this embodiment is the same as that of FIGS. 1–3.

In FIG. 5 I have illustrated a second embodiment of this invention in which the thrust plates 50 are of the same generally figure 8 form of plates 13 and 14. The front face (not shown) is flat as in plates 13 and 14. The rear face is a flat surface having semi-circular grooves 51 and 52 surrounding each opening 53 and 54 and spaced radially uniformly away from each such openings on the same side of the thrust plate grooves 51 and 52 are connected by a groove 55 across the neck 56 of plate 50 and extending radially between grooves 51 and 52. Three spaced radial grooves 57, 58 and 59 extend outwardly radially from grooves 51 and 52 generally opposite groove 55. A generally U-shaped rubber seal 60 having the configuration of all of the grooves is fitted in the grooves with the open side down. Rubber O-rings are placed in the groove of the U-shaped seal to hold it slightly above the surface of the thrust plate, precisely as in the embodiment of FIGS. 2–4.

While I have illustrated and described certain presently preferred practices and embodiments of my invention, it will be understood that this invention may be otherwise embodied within the scope of the following claims.

I claim:

1. In a rotary gear pump or motor having a case, a pair of meshing rotary gears in said case, said gears having axial stub shafts journaled in said case, the improvement comprising a unitary thrust plate for the corresponding ends of the pair of rotary gears adapted to lie between the case and the ends of the gears, said thrust plate being of a metal softer than the gears and having a front face adapted to abut the gear ends and a rear face abutting the case, a pair of spaced openings extending through said thrust plate to receive the gear stub shafts, a pair of connected at least half annular grooves in the rear face spaced from and surrounding each of said openings at least on one side, a groove in the rear face connecting said annular grooves at their closest points, at least one groove in the rear face extending radially from each said annular groove to the periphery of the body generally opposite the groove connecting the at least half annular grooves defining at least two substantially identical areas on opposite sides of the body, a generally U-shaped elastomer gasket having the contour of the combined grooves on the rear face of the body and fitting sealingly into said grooves with the opening of the U-shaped gasket opening downwardly in the groove resilient means normally urging said gasket partially out of said grooves into sealing contact with the case and fluid delivery means connecting said groove in the rear face between said annular grooves with said meshing gears intermediate the top and bottom of the U-shaped gasket whereby high pressure fluid passes along said fluid delivery means to said groove intermediate the top and bottom of the U-shaped gasket, down between the U-shaped gasket and groove and through beneath said gasket into the interior thereof to pressurize the gasket to the maximum pressure of the pump and said gasket acts as a check valve between the groove and fluid delivery means.

2. In a rotary gear pump or motor as claimed in claim 1 wherein the pair of grooves are full annulus grooves spaced equally around each opening.

3. In a rotary gear pump or motor as claimed in claim 1 or 2, a pair of passages extending from the groove connecting the annular grooves to the periphery of said body adapted to deliver pressure fluid from the case to said connecting groove.

4. In a rotary gear pump or motor as claimed in claim 1 or 2, a thrust plate body in the form of a figure 8.

5. In a rotary gear pump or motor as claimed in claim 1 or 2, the resilient means in the form of an elastomer O-ring having the configuration of said combined grooves.

6. In a rotary gear pump or motor as claimed in claim 1 or 2, wherein the resilient means are elongate side arms on the U-shaped gasket holding the gasket normally above the surface of the body.

7. In a rotary gear pump or motor as claimed in claim 1 or 2, wherein the ends of the gasket at the periphery of the thrust plate body are sealed.

8. In a rotary gear pump or motor as claimed in claim 7, a pair of passages extending from the groove connecting the annular grooves to the periphery of said body adapted to deliver pressure fluid from the case to said connecting groove to pressurize the area beneath the gasket.

9. A pressure plate for corresponding ends of a pair of cooperating gears in a rotary gear pump or motor comprising a metal body in the general form of a pair of joined rings arranged as a figure 8, having a front face adapted to abut the gear ends and a rear face spaced from and generally parallel to the front face, a pair of openings through the rings to receive gear shafts, a pair of at least half annular grooves in the rear face spaced from and surrounding each of said openings at least on one side, a groove in the rear face connecting said annular grooves at their closest points, at lease one groove in the rear face extending radially from each at least half annular groove to the periphery of the body generally opposite the groove connecting the annular grooves defining at least two substantially identical areas on opposite sides of the body, a generally U-shaped elastomer gasket having the contour of the combined grooves on the rear face of the body and fitting into said grooves with the opening of the U-shaped gasket opening downwardly in the groove and, resilient means acting on said gasket normally to urge it partially out of said grooves into sealing contact with the case and fluid delivery means extending across said plate transversly to said groove connecting said annular grooves and intersecting the same whereby high pressure fluid passes along said fluid delivery means to said groove intermediate the top and bottom of the U-shaped gasket, down between the U-shaped gasket and groove and through beneath said gasket into the interior thereof the pressurize the gasket to the maximum pressure of the pump and said gasket acts as a check valve between the groove and fluid delivery means.

10. A pressure plate as claimed in claim 9 wherein the pair of grooves are full annulus grooves spaced equally around each opening.

11. A pressure plate as claimed in claim 9 or 10 having a pair of passages extending from the groove connecting the annular grooves to the periphery of said body adapted to deliver pressure fluid from the gears to said connecting groove.

12. A pressure plate as claimed in claim 9 or 10 wherein the resilient means is in the form of an elastomer O-ring having the configuration of said combined grooves.

13. A pressure plate as claimed in claim 9 or 10, wherein the resilient means are elongate side arms on the U-shaped gasket holding the gasket normally above the surface of the body.

14. A pressure plate as claimed in claim 9 or 10 wherein the ends of the gasket at the periphery of the thrust plate body are sealed.

15. A pressure plate as claimed in claim 14, wherein a pair of passages extend from the groove connecting the annular grooves to the periphery of said body adapted to deliver pressure fluid from the gears to said connecting groove to pressurize the area beneath the gasket.

16. A rotary gear pump or motor comprising a case, a pair of rotary gears in said case, said gears having axial stub shafts journaled in said case, a unitary thrust plate for the corresponding ends of the pair of rotary gears adapted to lie between the case and the ends of the gears, said thrust plate being of a metal softer than the gears and having a front face adapted to abut the gear ends and a rear face abutting the case, a pair of spaced openings extending through said thrust plate to receive the gear stub shafts, a pair of annular grooves in the rear face spaced from and surrounding each of said openings, a groove in the rear face connecting said annular grooves at their closes points, at least one groove in the rear face extending radially from each annular groove to the periphery of the body generally opposite the groove connecting the annular grooves defining at least two substantially identical areas on opposite sides of the body, a generally U-shaped elastomer gasket having the contour of the combined grooves on the rear face of the body and fitting sealingly into said grooves with the opening of the U-shaped gasket opening downwardly in the groove resilient means normally urging said gasket partially out of said grooves into sealing contact with the case and fluid delivery means connecting said groove in the rear face between said annular groove with said meshing gears intermediate the top and bottom of the U-shaped gasket whereby high pressure fluid passes along said fluid delivery means to said groove intermediate the top and bottom of the U-shaped gasket, down between the U-shaped gasket and groove and through beneath said gasket into the interior thereof to pressurize the gasket to the maximum pressure of the pump and said gasket acts as a check valve between said gasket and fluid delivery means.

17. A rotary gear pump or motor as claimed in claim 16 having a pair of passages extending from the groove connecting the annular grooves to the periphery of said body adapted to deliver pressure fluid from the case to said connecting groove.

18. A rotary gear pump or motor as claimed in claim 16 wherein the thrust plate is in the general form of a figure 8.

19. A rotary gear pump or motor as claimed in claim 16 wherein the resilient means is in the form of an elastomer O-ring having the configuration of said combined grooves.

20. A rotary gear pump or motor as claimed in claim 16 wherein the resilient means are elongate side arms on the U-shaped gasket holding the gasket normally above the surface of the body.

21. A rotary gear pump or motor as claimed in claim 16 wherein the ends of the gasket at the periphery of the thrust plate body are sealed.

22. A rotary gear pump or motor as claimed in claim 21 wherein a pair of passages extending from the groove connecting the annular grooves to the periphery of said body adapted to deliver pressure fluid from the case to said connecting groove to pressurize the area beneath the gasket.

* * * * *

UNITED STATES PATENT AND TRADEMARK OFFICE

CERTIFICATE OF CORRECTION

PATENT NO. : 4,242,066

DATED : December 30, 1980

INVENTOR(S) : Robert F. Hodgson

It is certified that error appears in the above-identified patent and that said Letters Patent are hereby corrected as shown below:

Claim 9, column 4, line 60, "thereof the" should read --thereof to--.

Signed and Sealed this

*Twenty-first* Day of *April 1981*

[SEAL]

*Attest:*

RENE D. TEGTMEYER

*Attesting Officer*

*Acting Commissioner of Patents and Trademarks*